United States Patent [19]

Farnham et al.

[11] Patent Number: 5,054,931

[45] Date of Patent: Oct. 8, 1991

[54] COUNTERFLOW ASPHALT DRUM MIXER PRODUCING LESS HYDROCARBON EMISSIONS AND A METHOD USED THEREIN

[75] Inventors: Robert E. Farnham, Naperville; Fredric W. Prill, North Aurora, both of Ill.

[73] Assignee: Barber-Greene Co., DeKalb, Ill.

[21] Appl. No.: 35,076

[22] Filed: Apr. 6, 1987

[51] Int. Cl.[5] ..... B01F 9/06; E01C 19/10

[52] U.S. Cl. ..... 366/25; 366/57

[58] Field of Search ..... 366/6, 7, 22, 23, 24, 366/25, 34, 40, 54, 56, 57, 58; 34/28, 31, 33, 63, 109, 130, 137; 432/13, 105, 106, 108, 111, 118, 103, 14, 15, 16, 17, 18; 431/2, 350, 353; 126/343.5 A; 404/79, 83, 92

[56] References Cited

U.S. PATENT DOCUMENTS

| | | | |
|---|---|---|---|
| Re. 31,904 | 6/1985 | Mendenhall | 366/25 |
| 1,734,417 | 11/1929 | Briggs | 34/137 |
| 1,774,649 | 9/1930 | Hepburn et al. | 366/7 |
| 2,421,345 | 5/1947 | McConnaughay | 366/25 |
| 2,451,582 | 10/1948 | Smith | 432/13 X |
| 2,796,118 | 6/1957 | Parker et al. | 431/353 X |
| 2,818,112 | 12/1957 | Wedlick et al. | 431/353 X |
| 3,693,945 | 9/1972 | Brock . | |
| 4,095,284 | 6/1978 | Mendenhall | 366/7 |
| 4,103,350 | 7/1978 | Brock et al. | 366/22 |
| 4,136,966 | 1/1979 | Mendenhall | 366/25 |
| 4,147,436 | 4/1979 | Garbelman et al. | 366/25 |
| 4,190,370 | 2/1980 | Brock et al. | 366/25 |
| 4,286,944 | 9/1981 | Labriot et al. | 432/105 X |
| 4,298,287 | 11/1981 | McCarter et al. | 366/25 X |
| 4,332,478 | 6/1982 | Binz | 366/25 X |
| 4,377,978 | 3/1983 | Eusner | 432/105 X |
| 4,395,129 | 7/1983 | Musil | 366/25 |
| 4,522,498 | 6/1985 | Mendehall | 366/25 X |
| 4,555,182 | 11/1985 | Mendenhall | 366/25 |
| 4,600,379 | 7/1986 | Elliott | 366/25 X |
| 4,616,934 | 10/1986 | Brock | 366/4 |
| 4,787,938 | 11/1988 | Hawkins | 106/281.1 |

OTHER PUBLICATIONS

Actionews, vol. 1, No. 30, Jul. 16, 1976, pp. 5, 11, 13, 14 Published by the National Asphalt Pavement Association.

*Primary Examiner*—Harvey C. Hornsby
*Assistant Examiner*—Scott J. Haugland
*Attorney, Agent, or Firm*—Jones, Day, Reavis & Pogue

[57] ABSTRACT

A counterflow drum mixer producing less undesirable hydrocarbon gases and capable of more efficiently drying virgin aggregate. The drum mixer has a rotatable drum with first end receiving virgin aggregate and second end removing combined aggregate, reclaimed paving material, and mixed liquid asphalt. A burner projects into the drum from the outlet end and directs hot gases toward the inlet end. A reclaimed asphalt pavement inlet and a liquid asphalt inlet are located within the drum at a point isolated from the hot gases produced by the burner by a burner shield. When the drum mixer is operating, virgin aggregate moves down the drum toward the outlet counterflow to the drying hot gases projected toward the aggregate inlet by the burner. Reclaimed asphalt pavement is entered into the drum at a point behind the burner shield downstream (with respect to the flow of material) from the burner head producing the hot gases and is not exposed directly to those gases. Similarly, the liquid asphalt enters the drum in an inlet downstream of the burner shield, and fines may be mixed with the liquid asphalt at a mixing box. Less hydrocarbons are produced by this apparatus and method because the asphalt contained in the reclaimed asphalt paving material and the liquid asphalt are not directly exposed to radiation or the hot gases coming from the burner. The small amount of hydrocarbons produced are flowed into the burner to be incinerated.

2 Claims, 3 Drawing Sheets

FIG. 2
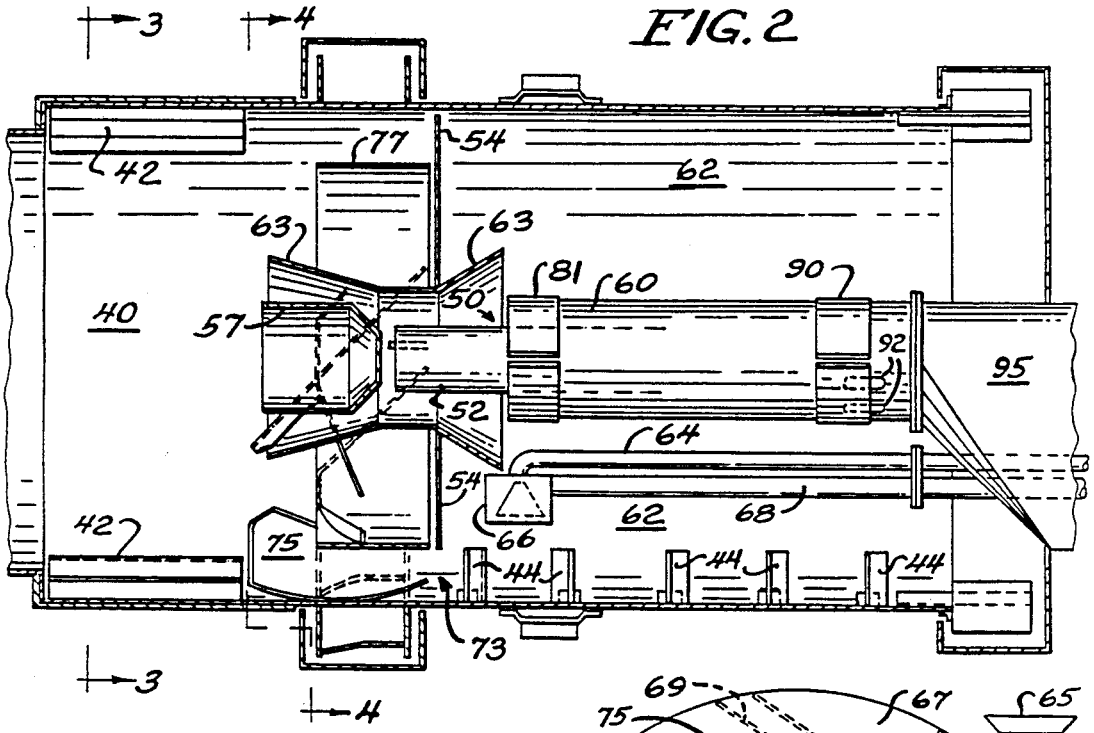
FIG. 4
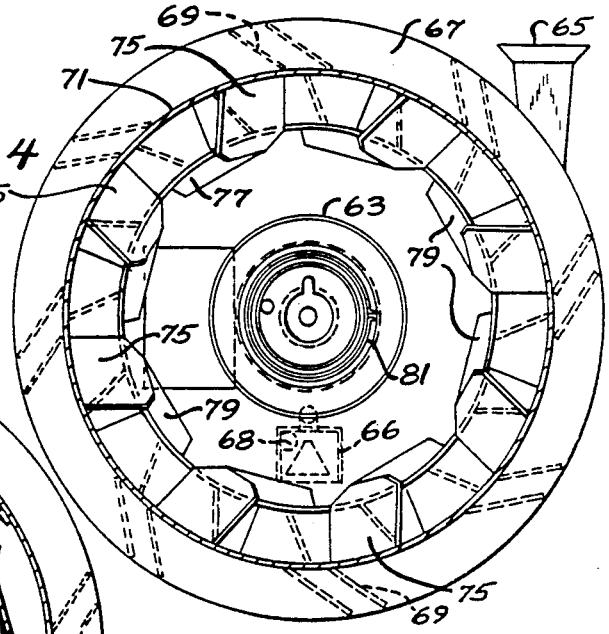
FIG. 3
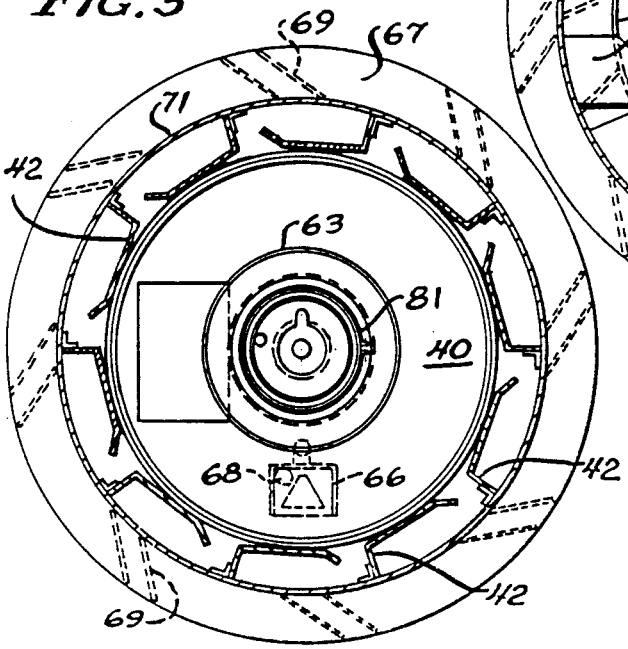
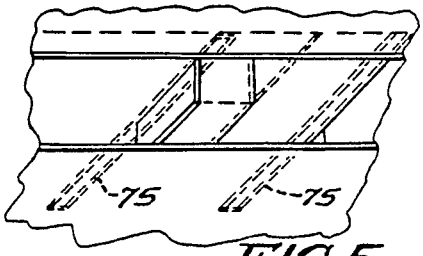
FIG. 5

FIG. 6
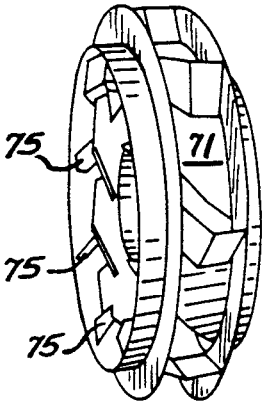
FIG. 7
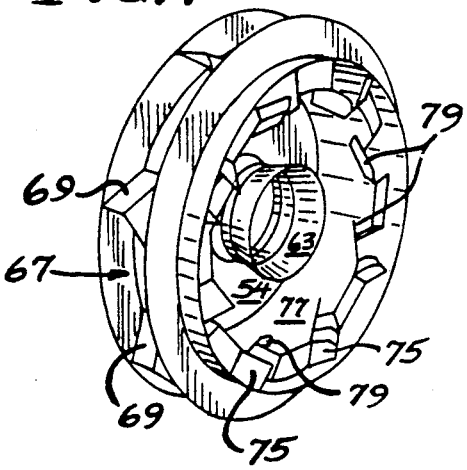
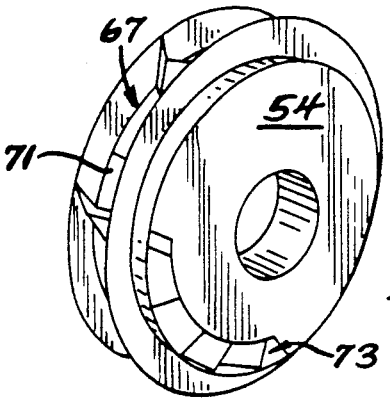
FIG. 8
FIG. 9
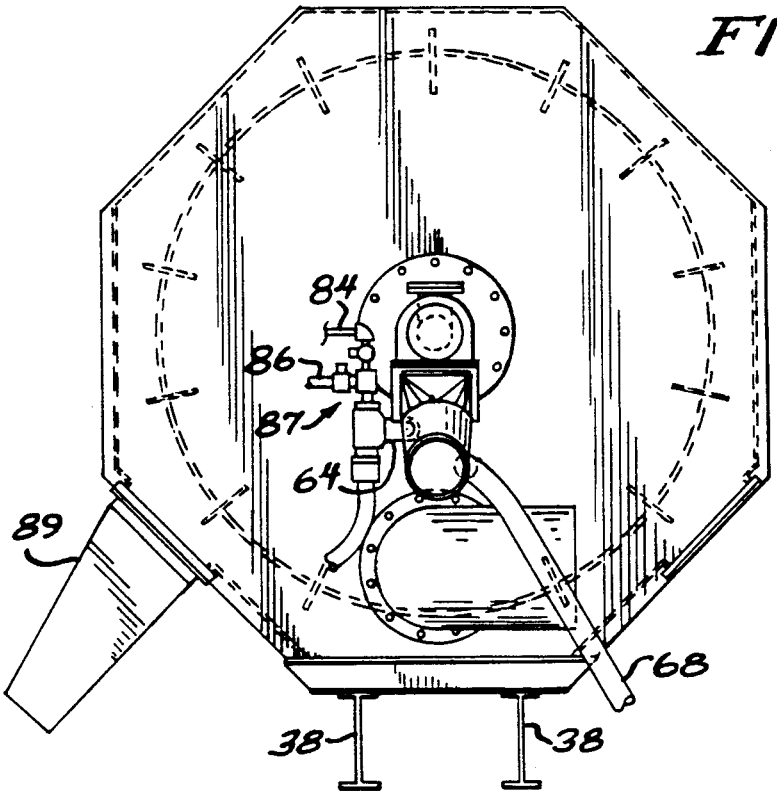

COUNTERFLOW ASPHALT DRUM MIXER PRODUCING LESS HYDROCARBON EMISSIONS AND A METHOD USED THEREIN

BACKGROUND OF THE INVENTION

The present invention pertains to producing paving material. Specifically, the invention relates to drum mixers which can be used to prepare asphalt material for paving.

In recent years, drum mixers have been accepted by the asphalt paving industry over the conventional batch plant mixers because of several advantages. Those advantages include lower equipment costs, a reduced amount of equipment necessary, and the ability to recycle asphalt paving materials. Unfortunately, drum mixers have a significant drawback, i.e. both liquid asphalt and asphalt-coated reclaimed material are exposed to high-temperature gases used for drying the aggregate in the drum mixer. While these gases are necessary to heat and dry the paving material, a "blue smoke" of hydrocarbon gases is produced from exposure of asphaltic material to high-temperature gases. With the advent of state and federal environmental pollution laws, use of the drum mixer requires strict control of emissions of this blue smoke.

In the past, elaborate techniques were utilized to reduce the gas temperature at the point where the liquid asphalt and asphalt-coated materials are introduced into the drum mixer. However, these methods were counterproductive to the purposes for which the gas is used in the drum mixer, i.e. the drying of the aggregate. This produced a slower, unacceptable production rate. Also, the mix itself, when hot enough to use for paving, will give off a small amount of blue smoke.

More recently, the drum mixer industry has attempted to deal with the blue smoke problem by removing the liquid asphalt either from direct addition to an area in the drum exposed to the hot gases, or from the drum itself. Each one of these attempts has been deficient in one way or another.

Standard Havens, Inc.'s new (MAGNUM) hot mix system features a separate chamber that allows the virgin aggregate and reclaimed asphalt pavement to drop out of the hot damaging gas stream before it is mixed with the liquid asphalt additives and fines. While this design concept allegedly eliminates stripping of the light ends that result in blue smoke, the thermal efficiency of this system is low and the exit velocity of the gases is high, causing a problem with very high dust carry out. Astec Industries' coater-mixer has a reclaimed asphalt pavement inlet downstream from the burner and virgin aggregate inlet and adds the liquid asphalt outside the drum. This device removes the liquid asphalt from the hotter gases produced by the burner but utilizes a very expensive mixing chamber or pugmill and does not minimize the exposure of reclaimed asphalt pavement to the hot gases. A third manufacturer, Cedar Rapids, manufactures a "drum in a drum" mixer. In that mixer, virgin aggregate is added in a drum containing the burner and hot gases produced from the burner while the reclaimed asphalt pavement is added initially into a larger drum surrounding the virgin aggregate drum. This mixer exposes the reclaimed asphalt pavement to hot gases and the hot part of the drum for a significant period of time. It should be noted that all three of these commercial drum mixers are parallel flow mixers, i.e. the paving materials travel in the same direction as the direction of flow of the hot gases.

It is an object of the present invention to lessen production of hydrocarbon gases while mixing asphaltic materials inside the drum mixer.

It is another object of the present invention to lessen production of hydrocarbon gases in the drum mixer and to achieve high thermal efficiency.

It is another object of the present invention to incinerate what hydrocarbon gases are unavoidably produced.

It is yet another object of the present invention to achieve counterflow drying of aggregate while removing recycled asphalt pavement and liquid asphalt from direct contact with the radiation and the hot gases produced by the burner.

Other objects, features, and advantages of this invention will be apparent from the following description and illustration of the preferred embodiment of the invention.

SUMMARY OF THE INVENTION

The present invention provides a drum mixer and a method for producing hot asphalt pavement from virgin aggregate, reclaimed asphalt pavement, liquid asphalt, and fines with less undesirable hydrocarbon gases being produced. The drum mixer accomplishes this result by moving the virgin aggregate, the reclaimed asphalt pavement and liquid asphalt, combined with the fines, through the drum in a direction opposite the direction of the hot gases produced by the burner.

In the present invention, the burner projects into the drum from the outlet end such that the burner head is a portion of the way up the drum mixer towards the inlet end. The virgin aggregate is exposed to the full length of the burner gases, being exposed to the coolest gases at the far end of the drum first when the virgin aggregate has just entered the drum and is cool. The virgin aggregate is exposed to the hottest gases, closer to the burner head, after the aggregate has been partially dried and heated. The counterflow of aggregate to drying gases more efficiently dries and heats the virgin aggregate by maintaining a large temperature difference between aggregate and gases all along the drum. On the other hand, the reclaimed asphalt pavement is removed from a direct exposure to the radiation or the hot gases produced by the burner by being introduced into the drum mixer at a point behind the burner head, between the burner head and the outlet end. Liquid asphalt and fines also are introduced out of the portion of the drum mixer exposed to the burner gases.

A burner shield is utilized to further isolate the reclaimed asphalt pavement and liquid asphalt from the radiation and the hot gases generated by the burner. This shield can effectively close off the entire cross-section of the drum, except for the small area which passes the virgin aggregate, to produce minimal air flow between these two portions of the drum. All fumes, including steam, produced in the rear mixing portion of the drum are to be directed through the flame of the burner, by induction through a venturi mounted in the burner shield and through which the burner tube projects These fumes may also be withdrawn from the mixing chamber and directed through the burner flame by means of a separate tertiary air fan.

A mixing chamber or space is defined between the burner shield and the drum mixer outlet end. It is expected that some blue smoke and steam will be produced in this mixing chamber where the reclaimed asphalt pavement and liquid asphalt are introduced to the already heated virgin aggregate. The shield is designed to incorporate a venturi, so that the flow of combustion air to the burner will induce flow of the blue smoke and steam given off by the reclaimed asphalt pavement into the combustion zone for incineration. Alternatively, a scavenge fan and conduit system will convey gases from the mixing chamber into the burner for combustion. The lower end of the drum, comprising the combustion zone and the mixing zone, may be enlarged in diameter so as to provide more volume for these processes.

Foamed liquid asphalt, such as produced by a method disclosed in Australian patent specification 24857 lodged Jan. 15, 1971 by Mobil Oil Australia Ltd., reduces the mixing time and distance in the drum mixer needed to adequately mix aggregate and reclaimed material in liquid asphalt. Accordingly, the short distance which the liquid asphalt travels in the drum mixer is more than adequate when a foamed liquid asphalt is used. However, use of a foamed liquid asphalt, while preferred, is not deemed essential for practice of this invention.

An additional advantage of the present invention is the location of the recycle material inlet at or near an area of zero (or very low) relative gas pressure. Accordingly, very little leakage air enters the drum at the recycle inlet or at the drum mixer outlet to dilute the hot gases in the drum mixer or reduce the overall efficiency of the drum mixer.

It should be noted that accomplishing mixing of the liquid asphalt with the aggregate and, in some cases, the reclaimed asphaltic material in a drum has advantages over accomplishing the mixing with a pugmill, or separate mixer, which are expensive pieces of equipment. Pugmills require a great deal of power. By contrast, providing a few additional feet of drum is relatively cheap. The additional power required is quite low, and cheaper to provide a larger drive motor for the larger drum rather than a separate pugmill drive motor. Also, no transfer mechanism (elevator or equivalent) from the drum to the pugmill or mixer is required. Retention time in the drum is needed both for mixing and for heat transfer from the virgin aggregate to the recycled material. An extended drum provides this in the most economical way. Any steam given off can be handled in the drum without additional scavenging ductwork.

BRIEF DESCRIPTION OF THE DRAWING

FIG. 2 shows a cross-sectional view of the burner shield and outlet and of the preferred embodiment.

FIG. 3 shows the cross-sectional view indicated at section lines 3—3 of FIG. 2.

FIG. 4 shows the cross-sectional view indicated at section lines 4—4 of FIG. 3.

FIG. 5 shows a partial view of the interior of the burner shield.

FIG. 6 shows a perspective view of the burner shield.

FIG. 7 shows a second perspective view of the burner shield.

FIG. 8 shows a third perspective view of the burner shield.

FIG. 9 shows the exterior of the outlet end of the preferred embodiment.

DETAILED DESCRIPTION OF THE PREFERRED EMBODIMENT

Figure 1:
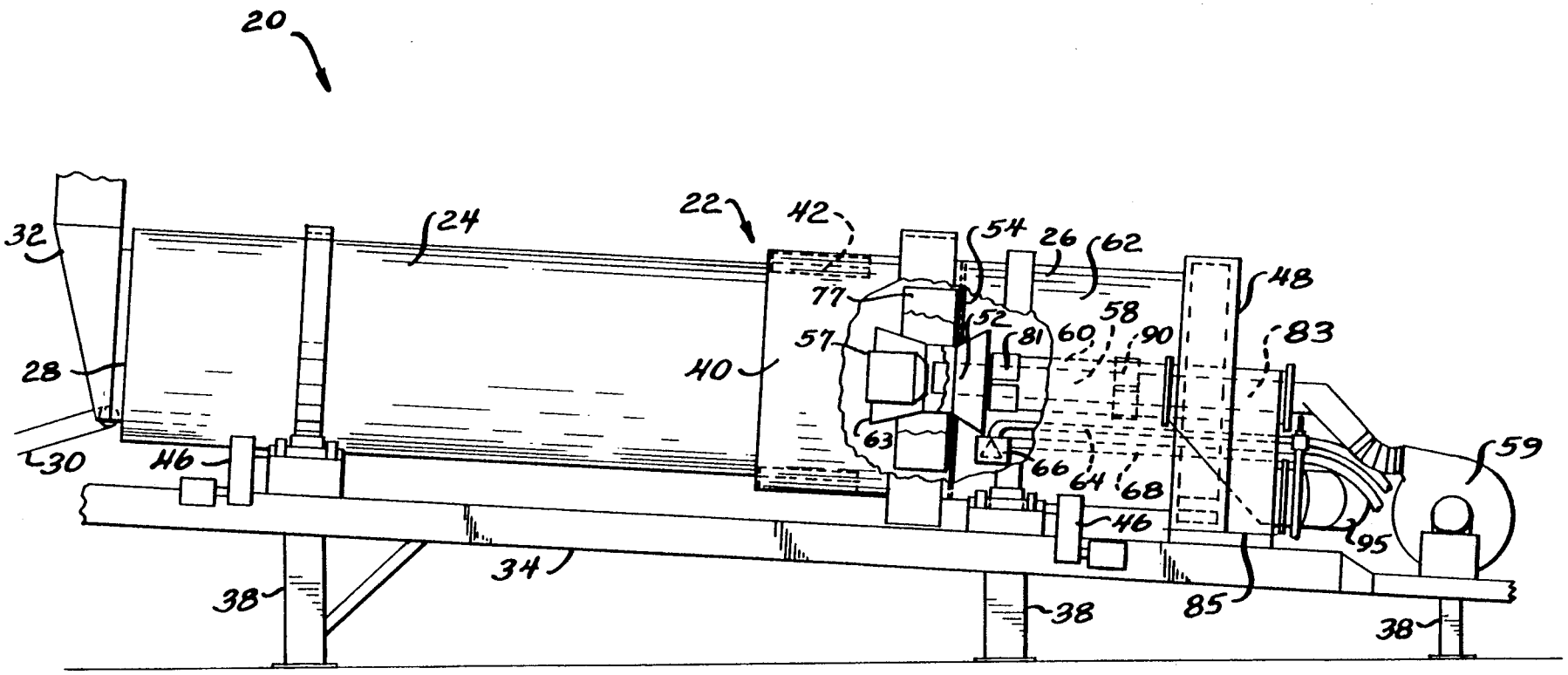
FIG. 1 shows the preferred embodiment of the drum mixer invention repeatedly partially cut-away, and with phantom lines showing internal structure.

The preferred embodiment of the present invention is designated generally in FIG. 1 as 20. The drum mixer is primarily comprised of a drum 22 with various inlets, an outlet and a burner. The drum 22 has first section 24 and second section 26 having larger diameter than first section 24. Of course, alternatively, the invention can be practiced with a drum mixer with second section 26 having equal or smaller diameter. The inlet end 28 of drum 22 is capable of receiving virgin aggregate from conveyor 30. Inlet end 28 also has exhaust gas outlet 32, to allow hot gases generated by the burner to be removed from the drum mixer.

The drum 22 is cylindrically-shaped and mounted rotatably on a frame 34 supported on legs 38. Wheels (not shown in the FIGS.) may be added to the frame to transport the drum mixer from location to location. The legs 38 are adjustable to tilt the drum mixer with inlet end higher than outlet end when the drum mixer and trailer are stationary. This tilting of the drum mixer assures that the materials put into the drum move from the inlet end to the outlet end under the force of gravity.

The first drum section 24 has cup flights (not shown in the FIGS.) on the drum interior to lift and drop the virgin aggregate through the main part of the hot gases coming from the burner, as is known in the art. The second section 26 of the drum has combustion zone 40 containing the flame from the burner. In the combustion zone 40, insulating flights 42 serve to shield the drum shell from direct radiation from the burner, absorbing heat and then giving it up to the cascading aggregate. In this area, the insulating flights do not create a veil of material because the flame could be quenched if relatively cold aggregate were dropped through it. The length of this portion of the drum depends on the design of the burner.

The second section 26 of the drum has stirring flights 44 (FIG. 2) which are used to mix the aggregate reclaimed material and liquid asphalt with the aggregate. The drum mixer is mounted on rotating mechanism 46 which allows the drum mixer to be rotated to both circulate the aggregate into the hot part of the gases coming from the burner, and for the stirring flights 44 in the second section 26 mixing area of the drum mixer 22 to produce a mixing action.

The outlet end 48 of the drum 22 allows the removal from the drum of the finished paving material. At that point, all the aggregate and reclaimed asphalt pavement and the liquid asphalt should be adequately mixed and ready to be applied to the road pavement. Material outlet 89 (FIG. 9) near drum outlet end 48 facilitates removal of the paving material.

The burner 50 with burner head 52 projects into the drum 22 toward the inlet end. It is capable of projecting hot gases into the drum towards the inlet end 28. Burner shield 54 surrounds burner head 52 to isolate the hot gases ejected from the burner from the reclaimed asphalt and liquid asphalt. The burner shield 54 creates an asphalt mixing zone 62 between the shield and the discharge end 48 of drum 22. The purpose of creating this space is to isolate the hot gases coming from the burner from the asphaltic materials in the zone 62 and to prevent recirculation of exhaust gases created in the zone 62. The reclaimed asphalt, allowed into the drum through the reclaimed asphalt material inlet, is not heated by the hot gases to produce blue smoke, but is mixed with the dried and heated virgin aggregate only in the mixing zone 62.

In order to properly maintain and control the flames ejected from the burner, an ignition tile 57 is provided slightly separated from the burner head 52 toward the inlet end 28 of the drum 22. Combustion air is provided to the flame by a number of routes. Primary air (normally 25–35% total stoichiometric air required for combustion) is supplied by the burner stem 58, which is fed air under pressure by primary air fan 59. Secondary air is provided through secondary air tube 60 which surrounds the burner stem 58. Air is provided through the secondary air tube 60 either from ambient sources, or from a fan and conduit system 95 to bring gases from the mixing air to the flame. A tertiary source of air is the mixing chamber 62 itself by using the velocity of the secondary air provided by tube 60 to directly draw gases from the mixing chamber 62. This direct draw of gases is accomplished preferably by using a venturi tube 63 which passes through an aperature in burner shield 54 and surrounds the burner head 52 and ignition tile 57. The venturi tube 63 is double-funnel or hour-glass shaped to create a venturi effect to draw gases at one end from the mixing area 62 to the flame by vacuum forces created by the flame at the other end of the venturi tube 63. The particular shape of venturi tube 63 is preferably as shown in FIGS. 1 and 2, but a venturi tube having a variant shape may adequately accomplish the purposes contemplated by the invention.

Reclaimed asphaltic pavement may be introduced into drum 22 through reclaimed material inlet 65 (shown in FIG. 4) which allows for free flow of material into reclaimed feeding space 67. As shown specifically in FIG. 8, a space is provided in the burner shield 54 through which the reclaimed material from the inlet 65, and the dried and heated virgin aggregate can pass into the mixing area 62. Reclaimed material scoops 69 supported on reclaimed material space wall 71, which may be the drum wall itself of drum second section 26, rotate with the drum and feed the reclaimed material through the burner shield material aperature 73.

The dried and heated aggregate material also passes to the mixing area 62 through material aperature 73 by the action of aggregate scoops 75 which are attached to ring 77 and rotate with the drum to "scoop" the virgin aggregate that has moved down (by force of gravity) from inlet 28. Scoops 75 urge, by virture of their rotating movement, the aggregate through aperature 73 in a controlled manner. Preferably, the reclaimed scoops 69 and aggregate scoops 75 are interspersed so as to alternatively feed into the mixing area aggregate and reclaimed material to encourage initial mixing of the two components. Flaps 79 on ring 77 help to recapture aggregate material that has rolled onto the ring 77. Action of the flaps, rotating with the ring, will void the wayward aggregate material wearing against the burner shield by the rotating ring.

Liquid asphalt also is deposited in the mixing area 62 near the recycle inlet. The liquid asphalt inlet 64 comprises a pipe coming up through the outlet end of the drum and ending into the top part of mixing box 66. The fines inlet 68 also comprises a pipe which enters the drum through the outlet end and ends in the mixing box. The mixing box, previously known in the art, mixes the fine material, usually reclaimed dust or other small particles, with the sticky liquid asphalt.

The mixing space 62 also creates an area where blue smoke created by the natural heating effect of being in the drum and in contact with the virgin aggregate is confined by the burner shield 54, and further facilitated by the means used that pass the virgin aggregate and reclaimed material through the burner shield. The small amount of blue smoke hydrocarbon gas which is produced in this area is drawn by the venturi created by the venturi tube 63 and action of the secondary air through tube 60. Alternatively, blue smoke in the mixing area can be circulated by a scavenge fan (not shown) through a conduit into the secondary air tube 60 and ultimately incinerated at the burner head 52. This recombustion of hydrocarbon smoke is possible because of the mixing area 62 provides an area to confine the blue smoke where it is primarily produced, out of the high-volume flow of gases from the burner which exit through exhaust outlet 32.

The burner 50 projects from the fan 59 and ends at burner head 52. The relative positioning of the recycle asphalt inlet, the burner head, and liquid asphalt inlet are important to the workings of the present invention. However, various relationships and relative positions of these three structures can be used without departing from the present invention.

As contemplated in the preferred embodiment of FIG. 1, the burner head 52 projects about ten feet into the drum 22. The venturi tube 63 and ignition tile 57 project about twelve feet into the drum 22, or about two feet beyond the burner head. The venturi tube 63 has its mid-section close to the same plane as the inlet means for the reclaimed material. The recycle inlet 65 will deposit reclaimed asphalt material at about the point of the burner head, but will be shielded from the hot gases which might be ejected at sharp angles from the burner head by the venturi tube 63 and ring 77. The liquid asphalt inlet 64, and therefore mixing box 65 and fines inlet 68, are about one to two feet behind the recycle inlet and burner head. Although this only provides for approximately eight feet of mixing of the liquid asphalt with the combined reclaimed material and virgin aggregate, this is adequate to mix the liquid asphalt into the mix. However, in the preferred embodiment, foamed liquid asphalt will be used because it can be mixed with less time and stirring. It is expected that six feet of mixing will be very adequate and provide a very good mixing of the foamed liquid asphalt with the other materials. It is expected that second drum section 26 could be as long as eleven and one-half feet, or longer, as needed. However, results obtainable from this lengthened section have not yet been clearly established though testing.

The preferred embodiment of the present invention is shown in detail in FIGS. 2–8. Second drum section 26 contains within it burner 50, ending at burner head 52, and surrounded by secondary air tube 60 and venturi tube 63. A triangular deflector (not shown) can be attached to the top of the secondary air tube 60 to deflect the mixed composition, which is being tumbled in the drum by the mixing paddles 44 over the tube, to keep the mixed composition from settling on top of the tube 60. A sliding collar 81 can be manually moved to effectively extend the length of the secondary air tube 60 in order to obtain the best venturi effect. This is often done by repeated trial and error in the field. A second collar 90 can be slid on the secondary air tube 60 to partially or fully cover air aperature 92 which adjusts the scavenging air in mixing chamber 62 and ultimately is a parameter which affects the flame characteristics.

The burner shield 54 and venturi tube 63 are preferably supported on the burner 50 and do not rotate with the drum. The burner 50, however, is entirely supported at its external end 83 by support 85.

After the reclaimed asphalt material and heated virgin aggregate enter the mixing chamber 62, near the burner shield side of the chamber, foamed liquid asphalt can be added to the composition through liquid asphalt inlet 64. Such foamed liquid asphalt is best produced by utilizing a spigot 87 which receives liquid asphalt, but also receives pressurized air through air conduit 84 and water through water conduit 86. The making of foamed liquid asphalt is known in the art, as mentioned above, but has particularly advantageous application to the present invention since the mixing of liquid asphalt with the other components must be accomplished in a relatively short mixing time/space. However, the invention certainly contemplates a structure and a method which utilizes a longer mixing chamber (second drum section) to allow adequate mixing with non-foamed liquid asphalt.

The method of the present invention is embodied in the figures and constitutes a counterflow drying of the virgin aggregate while depositing reclaimed asphalt and liquid asphalt downstream (with respect to the virgin aggregate) of the burner head to protect the asphaltic materials which, when heated, will produce blue smoke from direct contact with the hot gases produced by the burner. The steps include introducing virgin aggregate into the inlet of the drum, drying the aggregate with radiation and hot gases emitted from a burner projecting into the drum from its outlet end, introducing liquid asphalt into the mixing area of the drum (upstream of the hot gases produced by the burner), providing a shield between the hot gases and the asphalt to create the mixing area, mixing the virgin aggregate and liquid asphalt in the drum near the outlet end, and removing the combined virgin aggregate and liquid asphalt from the drum. Of course, additional steps such as adding reclaimed asphalt material into the mixing area or the drum, downstream of the hot gases also is contemplated. Further, the introduction of fines with the liquid asphalt in the mixing area is contemplated.

From the above description it will be apparent that there is provided a drum mixer and a method having desirable advantages, but which obviously are susceptible to modification in form, method, operation, detail construction, and arrangement without departing from the principles involved or sacrificing any of its advantages.

It is to be understood that the invention is not limited to the specific features shown, but that the means, method, and construction herein disclosed comprise the preferred form of several modes of putting the invention into effect, and the invention is, therefore, claimed in any of its forms or modifications within the legitimate and valid scope of the appended claims.

What is claimed is:

1. A counterflow drum mixer comprising:

a cylindrical, rotatable drum having opposed inlet and outlet ends, the inlet end capable of receiving virgin aggregate;

a burner having burner head projecting into the drum from the outlet end of the drum, the burner capable of directing hot gases toward the inlet drum end;

means for moving paving material through the drum from the inlet end to the outlet end of the drum;

a burner shield annularly surrounding the burner to define a mixing area near the outlet end of the drum isolated from radiation and hot gases produced by the burner, the burner shield having means to allow virgin aggregate to pass toward the outlet end of the drum;

a venturi tube surrounding the burner head and communicating through the burner shield;

means for introducing reclaimed asphaltic pavement into the mixing area of the drum; and means for introducing liquid asphalt into the mixing area of the drum;

whereby, when the drum mixer is operating, the virgin aggregate moves from the inlet end of the drum toward the burner and the mixing of the liquid asphalt and reclaimed asphaltic pavement occurs in the isolated mixing area;

wherein the burner shield supports the venturi tube to surround the burner head; and wherein the venturi tube is hour-glass shaped, and has cylindrical mid-section attached to the burner shield at a central aperature in the burner shield.

2. A counterflow drum mixer comprising:

a cylindrical, rotatable drum having opposing inlet and outlet ends, the inlet end capable of receiving virgin aggregate;

a burner having a burner head projecting into the drum from the outlet end of the drum, the burner capable of directing hot gases toward the inlet drum end;

means for moving paving material through the drum from the inlet end to the outlet end of the drum;

a burner shield annularly surrounding the burner to define a mixing area near the outlet end of the drum isolated from radiation and hot gases produced by the burner, the burner shield having means to allow virgin aggregate to pass toward the outlet end of the drum;

a venturi tube surrounding the burner head and communicating through the burner shield, the venturi tube having one end communicating with the mixing area;

means for introducing heat sensitive material into the mixing area of the drum;

whereby, when the drum mixer is operating, the virgin aggregate moves from the inlet end of the drum toward the burner, and the mixing of the heat sensitive material with the virgin aggregate occurs in the isolated mixing area and wherein the burner shield contains an aperature wherein the means to allow the virgin aggregate to pass through the burner shield comprises a cylindrical ring attached to the drum, the ring having scoops to feed the aggregate through the aperature in the burner shield.

* * * * *